US008863324B2

(12) United States Patent
Tempas et al.

(10) Patent No.: US 8,863,324 B2
(45) Date of Patent: Oct. 21, 2014

(54) BATHTUB RIM ASSEMBLY

(75) Inventors: Jeffrey F. Tempas, Oostburg, WI (US); Christopher B. Hisey, Plymouth, WI (US); Steven A. Abitz, Sheboygan, WI (US); Scott R. Knapp, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 675 days.

(21) Appl. No.: 12/060,035

(22) Filed: Mar. 31, 2008

(65) Prior Publication Data

US 2009/0241256 A1 Oct. 1, 2009

(51) Int. Cl.
*A47K 3/02* (2006.01)

(52) U.S. Cl.
CPC ..... *A47K 3/02* (2013.01); *A61H 2201/0165* (2013.01)
USPC ..... 4/584; 4/592; 4/593

(58) Field of Classification Search
USPC ..... 4/584, 592–595, 363, 648; 52/169.7; 29/428; 607/85
See application file for complete search history.

(56) References Cited

U.S. PATENT DOCUMENTS

| | | | | | |
|---|---|---|---|---|---|
| 2,528,432 | A * | 10/1950 | Heckathorn | | 4/595 |
| 2,697,231 | A * | 12/1954 | Strand | | 4/595 |
| 3,561,019 | A * | 2/1971 | Roland | | 4/593 |
| 4,290,154 | A * | 9/1981 | Benjamin | | 4/538 |
| 5,182,821 | A | 2/1993 | Bufford et al. | | |
| 5,333,325 | A * | 8/1994 | Levien et al. | | 4/584 |
| 5,477,568 | A * | 12/1995 | Wang | | 4/592 |
| 5,665,141 | A * | 9/1997 | Vago | | 95/30 |
| 5,901,508 | A * | 5/1999 | Menzel | | 52/34 |
| 6,360,380 | B1 | 3/2002 | Swart et al. | | |
| 6,523,191 | B2 | 2/2003 | Lahay et al. | | |
| 6,775,862 | B1 | 8/2004 | Christensen | | |
| 7,412,206 | B1 * | 8/2008 | Hutchings et al. | | 455/3.06 |
| 2004/0221383 | A1 * | 11/2004 | Sieger et al. | | 4/584 |
| 2009/0235448 | A1 * | 9/2009 | Knapp et al. | | 4/541.1 |
| 2009/0241253 | A1 * | 10/2009 | Glasford et al. | | 4/541.1 |
| 2009/0241254 | A1 * | 10/2009 | Glasford et al. | | 4/541.1 |

FOREIGN PATENT DOCUMENTS

| | | | | |
|---|---|---|---|---|
| DE | 3014089 | A1 | 4/1980 | |
| DE | 8627707.3 | U1 | 8/1987 | |
| DE | 202004018797 | U1 | 3/2005 | |
| DE | 102004040913 | | 11/2005 | |
| DE | 102004040913 | B3 * | 11/2005 | B29C 44/12 |
| EP | 1245216 | A1 | 2/2002 | |
| EP | 1275365 | A2 | 1/2003 | |
| GB | 2040676 | | 9/1980 | |
| GB | 2040676 | A * | 9/1980 | |
| JP | 55-131743 | | 3/1954 | |
| JP | 58-25130 | | 5/1957 | |

(Continued)

OTHER PUBLICATIONS

Translation of DE 102004040913.*

(Continued)

*Primary Examiner* — Huyen Le
*Assistant Examiner* — Lauren Heitzer
(74) *Attorney, Agent, or Firm* — Foley & Lardner LLP

(57) ABSTRACT

A bathtub rim assembly is disclosed that includes a support structure that is capable of engaging a rim of a bathtub to prevent substantial deformation and damage to a cantilevered ledge of the bathtub. The rim assembly further includes a skirt that obscures the support structure to maintain a unitary appearance of the overall bathtub assembly.

20 Claims, 9 Drawing Sheets

(56) References Cited

FOREIGN PATENT DOCUMENTS

| | | |
|---|---|---|
| JP | 58-25131 | 5/1957 |
| JP | 58-25132 | 5/1957 |
| JP | 58-25133 | 5/1957 |
| JP | 58-28636 | 5/1957 |
| JP | 58-10050 | 1/1958 |
| JP | 58-69562 | 4/1983 |
| JP | 58-131786 | 9/1983 |
| JP | 59-8329 | 1/1984 |
| JP | 59-12902 | 4/1984 |
| JP | 2-98766 | 7/1990 |
| JP | 7-16688 | 3/1995 |

OTHER PUBLICATIONS

Kohler, Turnings Vessels Lavatory (K-2191-G).
Five pages of a PCT search report dated Mar. 11, 2010 in a corresponding application PCT/US2009/001948.

* cited by examiner

BATHTUB RIM ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to a rim assembly for use with a bathtub. More particularly, the invention relates to a rim assembly that supports a cantilevered ledge of a bathtub, provides vibratory isolation between the rim of the bathtub and a mounting deck, and establishes a substantially unitary appearance of a skirt about the bathtub to obscure the support structure.

Certain bathtub mounting configurations give the bathtub the appearance of rising up and flaring out from a bathtub mounting deck, commonly referred to as a "vessels-mount." While aesthetically pleasing, this design results in a rim having a relatively large, unsupported ledge. The ledge is further cantilevered when the basin of the bathtub is offset toward one side of the bathtub. The cantilevered ledge is susceptible to deforming and cracking during use. For example, it is natural for bathers to either sit on the rim or utilize the wide ledge to support some of their weight as they enter and exit the bathtub.

The situation is further complicated where transducers are mounted to the bathtub for the purpose of vibrating the bathtub. The flared rim and its cantilevered ledge may amplify the vibrations, ultimately increasing the potential that the vibrations will be transferred from the bathtub to the surrounding bathtub mounting deck. The vibrations passed to the deck generate additional unwanted noise and vibration to the surroundings. These undesirable vibrations can cause stress in the rim and may produce rattles when the rim and bathtub mounting deck interact, ultimately leading to the perception of poor-quality construction.

As a result, a need exists for a bathtub rim assembly that supports the cantilevered ledge of a bathtub, isolates bathtub vibrations from the surrounding mounting deck, and maintains the desired bathtub aesthetics.

SUMMARY OF THE INVENTION

The present invention comprises a bathtub rim assembly including a support structure capable of engaging a rim of a bathtub to prevent substantial deformation and damage resulting from forces imparted to a cantilevered ledge. The bathtub rim assembly also includes a skirt that obscures the support structure to maintain a unitary appearance of the overall bathtub assembly.

In one aspect, a bathtub rim assembly is mountable to a bathtub having a rim defining a ledge spaced apart from a mounting deck. The assembly includes a support structure defining a plurality of strengthening formations, having an inner periphery for receiving the bathtub, and having an outer periphery. The assembly further includes a skirt having an inner periphery for receiving the bathtub and an outer periphery. The support structure is disposed adjacent the ledge of the bathtub to support the ledge. And, the skirt is disposed to a side of the support structure opposite the ledge such that the outer periphery of the skirt is overlapped by at least one of the outer periphery of the support structure or the ledge to establish a substantially unitary appearance between the ledge and the skirt.

In another aspect, a bathtub rim assembly is mountable to a bathtub having a rim defining a ledge spaced apart from a mounting deck that has an opening through which a basin of the bathtub extends. The assembly includes a support structure defining a plurality of strengthening formations, having an inner periphery for receiving the bathtub, and having an outer periphery defining a downwardly depending lip. The assembly further includes a skirt having an inner periphery for receiving the bathtub and an outer periphery defining an upwardly extending flange. The support structure is disposed adjacent the ledge of the bathtub to support the ledge. And, the skirt is disposed to a side of the support structure opposite the ledge such that the lip of the support structure overlaps at least a portion of the flange of the skirt to establish a substantially unitary appearance between the ledge and the skirt.

In a further aspect, a method of installing a bathtub rim assembly to a bathtub having a rim defining a ledge includes the steps of providing a support structure defining a plurality of strengthening formations, and having an inner periphery for receiving the bathtub and an outer periphery, and providing a skirt having an inner periphery for receiving the bathtub and an outer periphery. The method further includes the steps of engaging the support structure and the ledge of the bathtub to embed at least a portion of the support structure into the bathtub proximate the ledge, curing the bathtub to substantially couple the support structure and the bathtub, and overlapping at least one of the outer periphery of the support structure or the ledge over the outer periphery of the skirt to establish a substantially unitary appearance between the ledge and the skirt.

These and still other aspects of the present invention will be apparent from the detailed description and drawings. What follows are merely preferred example embodiments of the present invention. The claims should be referenced to assess the full scope of the invention.

DETAILED DESCRIPTION OF THE PREFERRED EXAMPLE EMBODIMENT

The present invention is described in relation to a bathtub configuration in which the bathtub has the appearance of flaring upward and outward from its mounting deck, known as a "vessels-style" design. This type of design results in a rim having an unsupported, cantilevered ledge that is spaced apart from the mounting deck. The invention, however, is equally applicable to the numerous bathtub configurations that may benefit from increased structural support of a bathtub rim while maintaining a substantially unitary appearance of the overall bathtub assembly.

Figure 1:
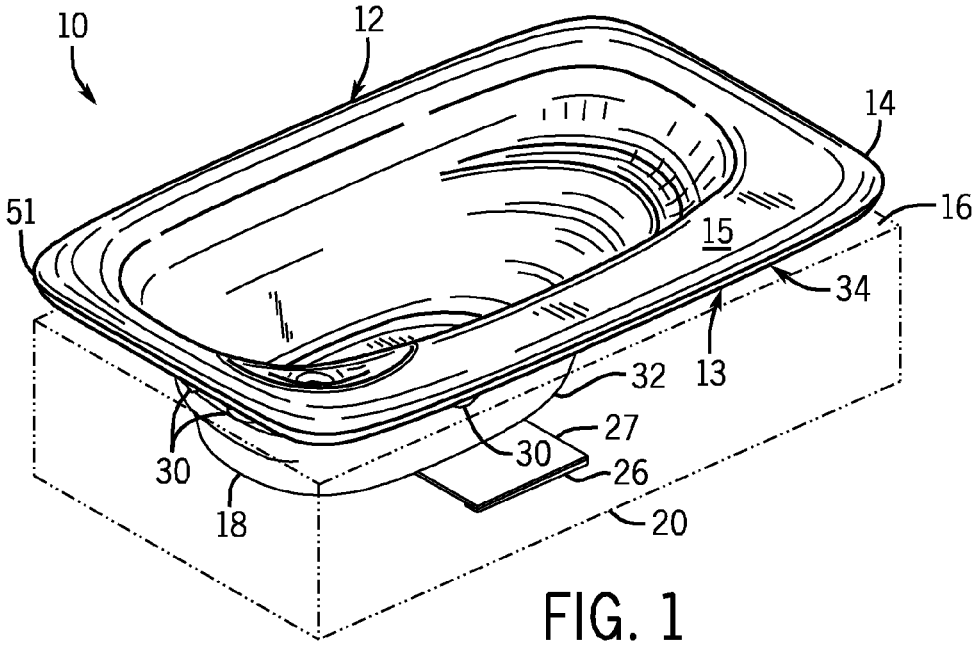
FIG. 1 is an isometric view of a bathtub assembly incorporating the present invention.

A bathtub assembly 10, shown in FIG. 1, includes a bathtub 12 having a rim 14 that has the appearance of flaring upward and outward from a mounting deck 16 (i.e., a "vessels-style" bathtub). The rim 14 defines a cantilevered ledge 15 that is spaced apart from the mounting deck 16. The distance between the ledge 15 and mounting deck 16 can vary depending on the application and design requirements. Additionally, the wide ledge 15 need not extend around the entire rim 14 of the bathtub 12, for example, when the bathtub 12 is installed close to an adjacent wall (not shown).

Figure 2:
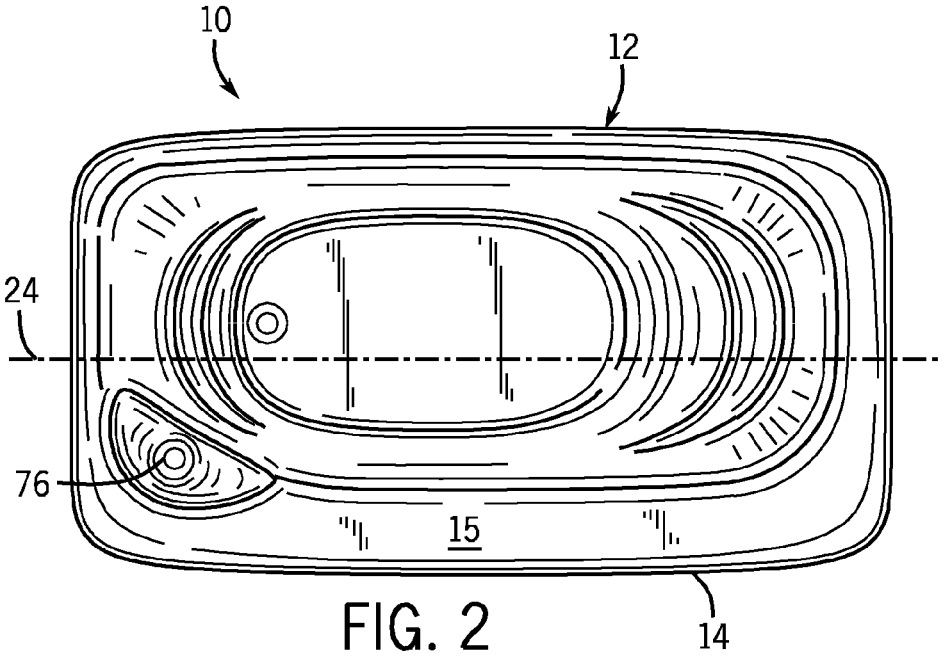
FIG. 2 is a top view of the bathtub assembly shown in FIG. 1.

A basin 18 extends into an opening 17 formed in the mounting deck 16 to support the weight of the bathtub 12 adjacent a sub-floor 20. Looking down on the bathtub 12, as illustrated in FIG. 2, the basin 18 is shown shifted from a centerline 24, resulting in the cantilevered ledge 15 being wider on one side of the bathtub 12. As a result, when a bather enters and exits the bathtub 12, they may have a tendency to step or lean on the wider area of the ledge 15, causing increased stress on the rim 14 that may cause deformation or damage to the bathtub 12.

Figure 3:
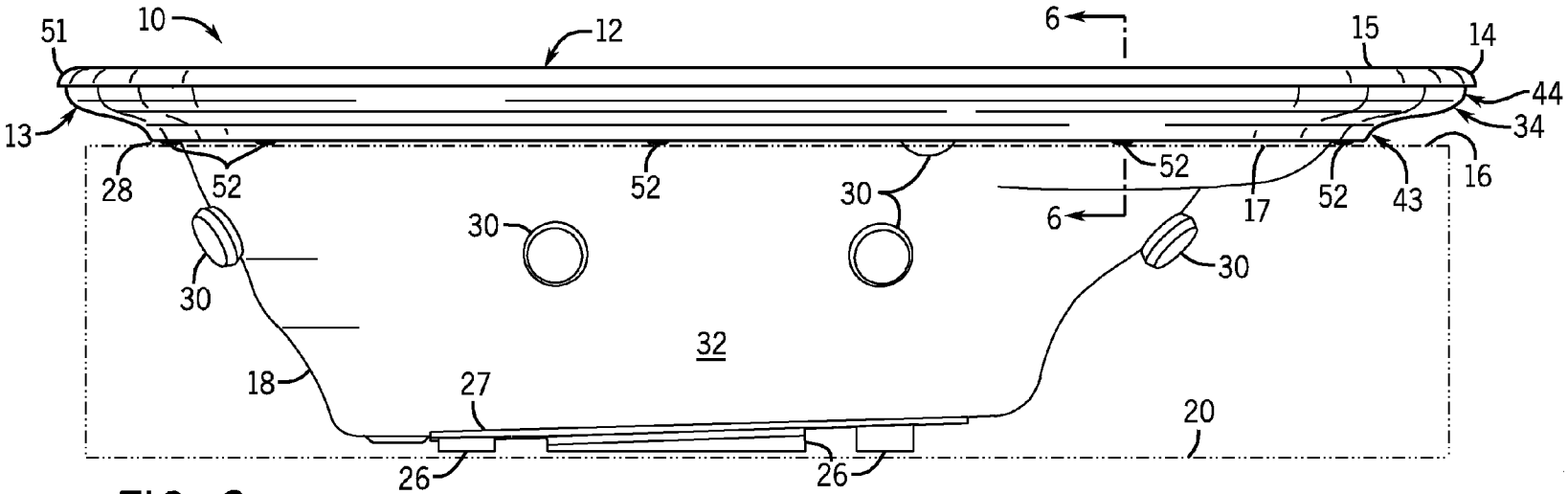
FIG. 3 is a side elevation view of the bathtub assembly shown in FIG. 1.
Figure 4:
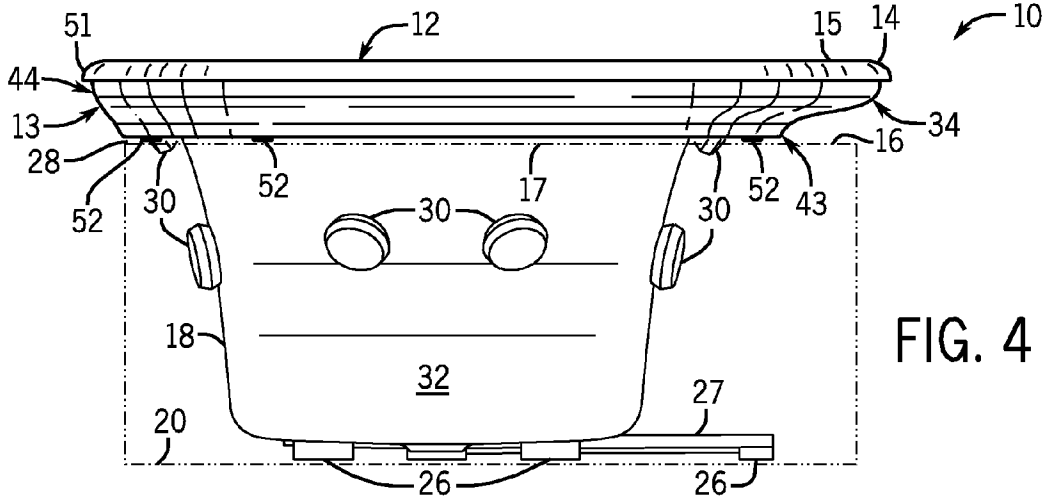
FIG. 4 is an end elevation view of the bathtub assembly shown in FIG. 1.

With additional reference to FIGS. 3 and 4, the bathtub 12 and bathtub rim assembly 13 are shown in greater detail. Mounting blocks 26 and a mounting brace 27 are located under the basin 18 of the bathtub 12 to support the weight of the bathtub 12 adjacent the sub-floor 20. The mounting brace 27 extends from under the basin 18 toward the wider portion of the rim 14 to provide additional stability to the entire bathtub 12. It is preferable that the rim 14 not support the weight of the bathtub 12, as this would cause increased stress in the rim 14. Therefore, the mounting blocks 26 and the mounting brace 27 are shimmed during installation to establish a slight gap 28 between the bathtub 12 and the mounting deck 16, best shown in FIG. 6.

The bathtub 12 of the example embodiment further includes a series of transducers 30 affixed at various locations about an exterior surface 32 of the bathtub 12. The transducers 30 are operationally coupled to a signal source (not shown) that provides signal power to drive the transducers 30, ultimately vibrating the bathtub 12, including the cantilevered ledge 15.

The bathtub rim assembly 13 of the present invention includes structures to accommodate the potential stresses and vibrations imparted to the cantilevered ledge 15 while maintaining the flowering aesthetics of the vessels-style bathtub 12. With additional reference to FIGS. 5 and 6, the bathtub rim assembly 13 includes a skirt 34 and a support structure 36 that are coupled to the underside 38 of the rim 14.

The support structure 36 provides additional rigidity to the rim 14 of the bathtub 12. The support structure 36 has an inner periphery 37 that is configured to generally receive the bathtub 12. An outer periphery 39 of the support structure 36 is generally configured to overlap the skirt 34 and preferably includes a downwardly depending lip 41. The lip 41 defines a portion of a channel 62 that extends substantially about the outer periphery 39 of the support structure 36. The support structure 36 of the example embodiment is preferably made of fiberglass due to a favorable strength-to-weight ratio; however, the support structure 36 may be made of any number of suitable plastics, metals, composites, and the like, and may be molded, machined, assembled, or formed accordingly.

Figure 6:
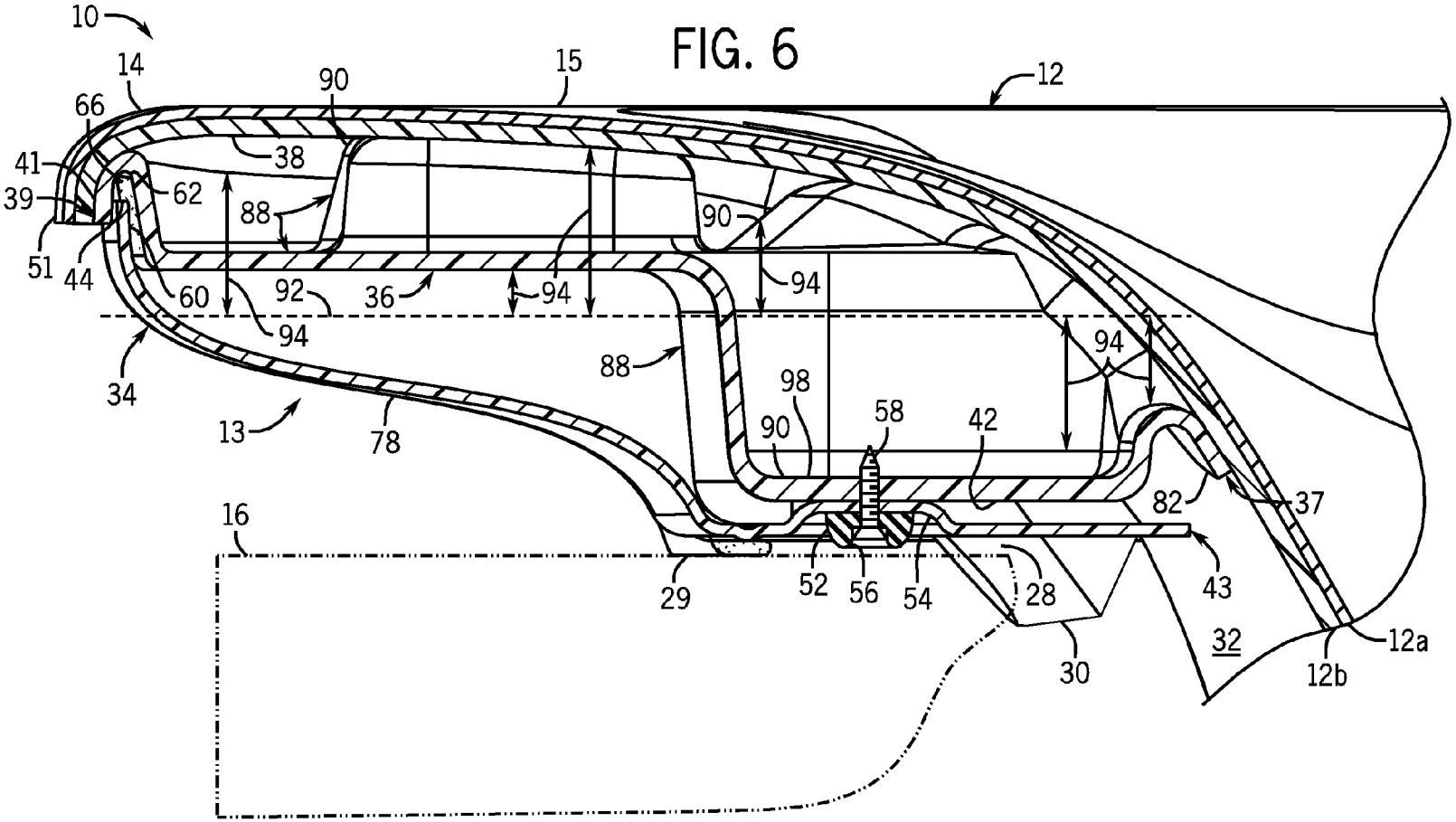
FIG. 6 is a partial section view along line 6-6 of FIG. 3.

With specific reference to FIG. 6, the bathtub 12 includes an outer shell 12*a* backed by an inner shell 12*b*. The outer shell 12*a* is preferably made of acrylic and the inner shell 12*b* is preferably made of fiberglass (e.g., a chop-resin mixture). However, as one skilled in the art will appreciate, the bathtub 12 may be made of a variety of materials and still benefit from the present invention.

In the preferred embodiment incorporating an inner shell 12*b* made of a fiberglass-resin mixture, the support structure 36 oriented adjacent the ledge 15 and is pressed into engagement with the inner shell 12*b* before the resin has fully cured. An adhesive material may be sprayed over the support structure 36 and inner shell 12*b* to better adhere the two components together; however, the preferred example embodiment does not incorporate any additional adhesive. Mating surfaces 42 located on the support structure 36 are masked from the spray laminate to aid in subsequent assembly of the support structure 36. This bonding technique helps ensure that the bathtub 12 and the support structure 36 form a rigid connection such that loads imparted to the bathtub 12, and specifically the cantilevered ledge 15, are transferred to and supported by the imbedded support structure 36. One skilled in the art will appreciate the various resins and bonding techniques available to couple the support structure 36 to the bathtub 12.

Various other techniques may be used to couple the bathtub 12 and the support structure 36. For example, a series of threaded studs may be embedded into the fiberglass-resin mixture to extend from the underside 38 of the bathtub 12. The studs pass through a series of mating openings formed in the support structure 36. A series of nuts are then threaded to the studs to clamp the support structure 36 to the underside 38 of the bathtub 12.

Where the bathtub 12 is produced from other materials, one skilled in the art will appreciate the adaptation of the coupling of the support structure 36 to the bathtub 12. Other methods of attachment may be used, such as adhesives, ultrasonic welding, fasteners, and the like. Additionally, the support structure 36 may be integrally molded with the bathtub 12 eliminating the use of a separate support structure 36.

The coupling of the support structure 36 to the bathtub 12, specifically at locations underneath the rim 14, increases the rigidity and strength of the overall rim 14 to better resist external forces (e.g., a bather sitting on the ledge 15 during entry or exit). Less deflection of the rim 14 minimizes the potential for damage to the bathtub 12. Furthermore, the support structure 36 reduces the movement of the rim 14 in response to the vibrations imparted to the bathtub 12 by the transducers 30. This too reduces the potential for cracking or fatigue damage to the bathtub 12.

The bathtub rim assembly 13 further includes a skirt 34 that is configured to be overlapped by the support structure 36 to create an aesthetically pleasing transition between the mounting deck 16 and the rim 14 of the bathtub 12, as shown in FIGS. 3 and 4. The skirt 34 is disposed proximate the side of the support structure 36 that is opposite the ledge 15 (shown best in FIG. 6). The skirt 34 generally obscures the support structure 36 from the view of a bather and, in the preferred embodiment, is overlapped by the outer periphery 39 of the support structure 36 to establish a substantially unitary appearance between the skirt 34 and the ledge 15 of the bathtub 12. As a result, the cantilevered ledge 15 is supported by the support structure 36 while the vessels-style appearance is maintained.

Figure 7:
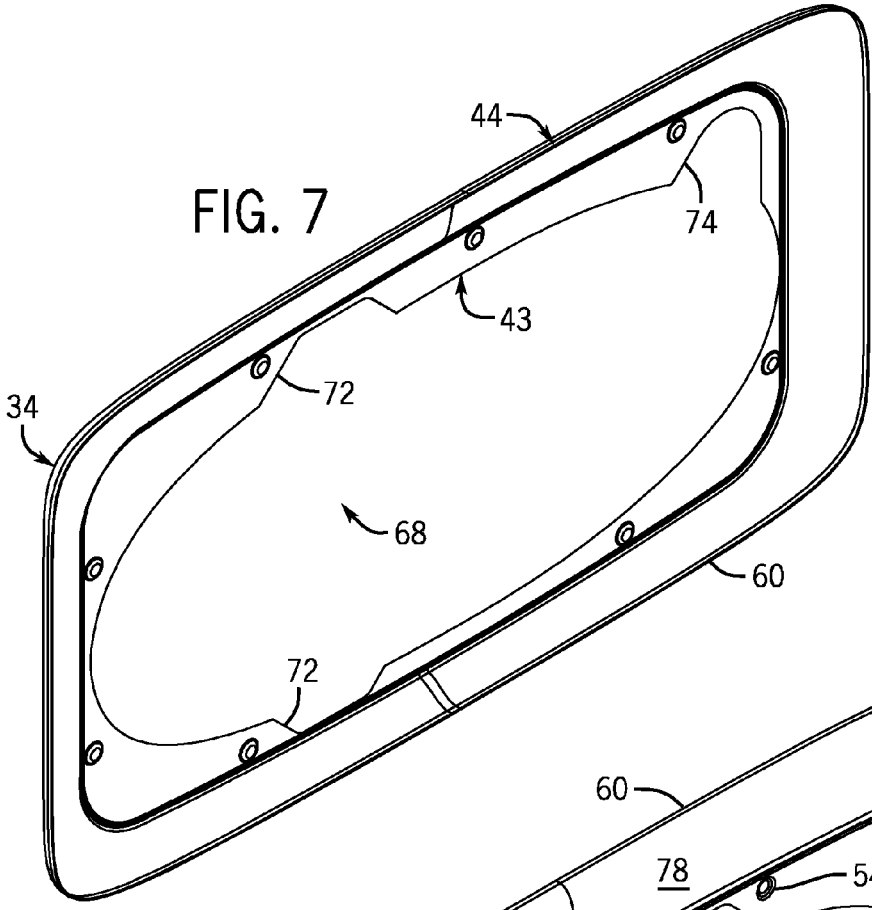
FIG. 7 is a top isometric view of a skirt in accordance with the present invention.
Figure 8:
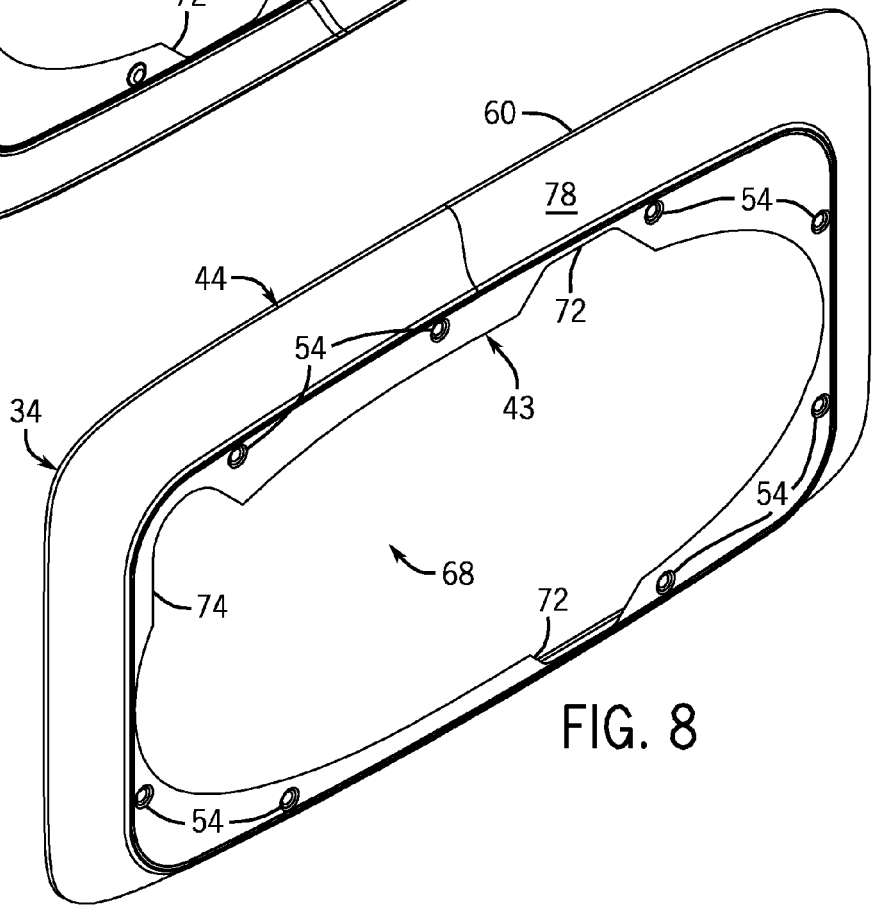
FIG. 8 is a bottom isometric view of the skirt shown in FIG. 7.
Figure 9:
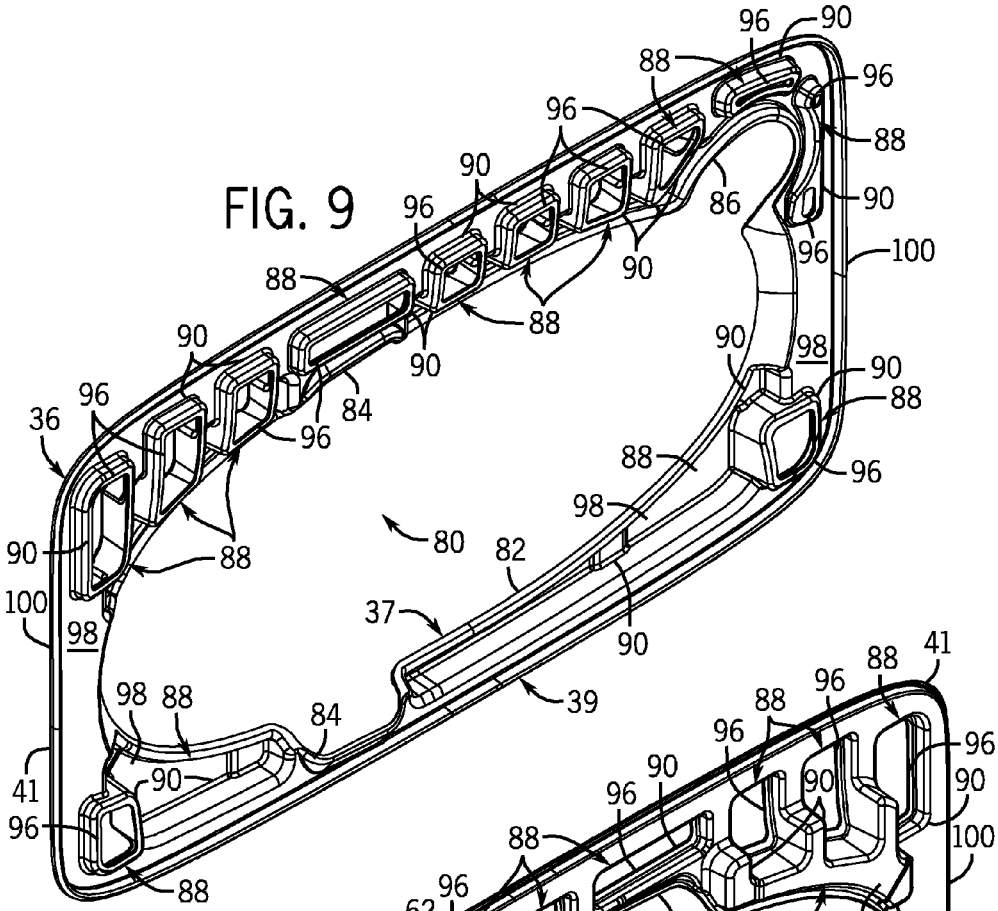
FIG. 9 is a top isometric view of a support structure in accordance with the present invention.
Figure 10:
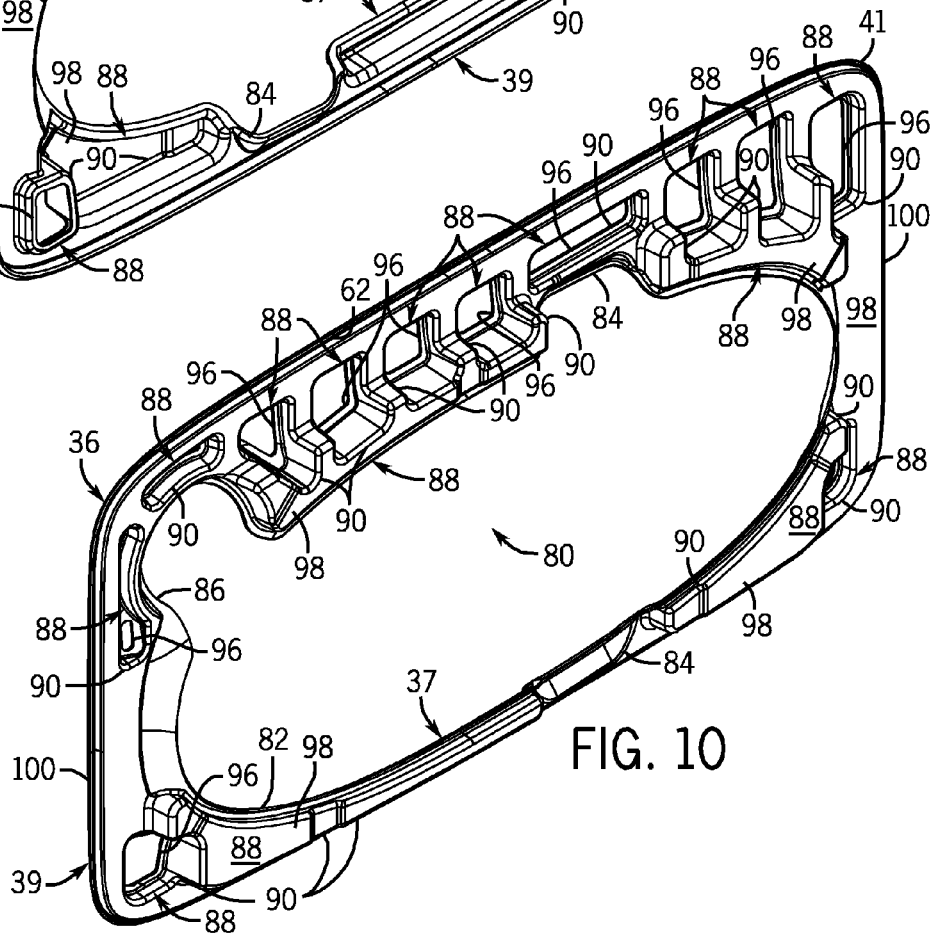
FIG. 10 is a bottom isometric view of the support structure shown in FIG. 9.

The skirt 34 has an inner periphery 43 that is configured to receive the bathtub 12. An outer periphery 44 of the skirt 34 includes an upwardly extending flange 60 that is seated in the channel 62 formed about the outer periphery 39 of the support structure 36. The lip 41 of the support structure 36 overlays or overlaps the flange 60 of the skirt 34 to establish the transition between the ledge 15 and the skirt 34. The flange 60 of the skirt 34 is best shown in FIGS. 6-8. As a result, the skirt 34 provides the appearance of a relatively uniform transition between the rim 14 and the mounting deck 16 (best shown in FIGS. 3, 4, and 6). A bead of silicone 66, or similar material, is used to secure the flange 60 of the skirt 34 into the channel 62, further unifying the transition between the bathtub 12 and the skirt 34. Again, one skilled in the art will recognize the variations available to engage the skirt 34 and the support structure 36.

As with the support structure 36, the skirt 34 may be molded from plastic, made of fiberglass composite, or any other suitable material and method. The skirt 34 is mainly intended to provide pleasing aesthetics.

Figure 5:
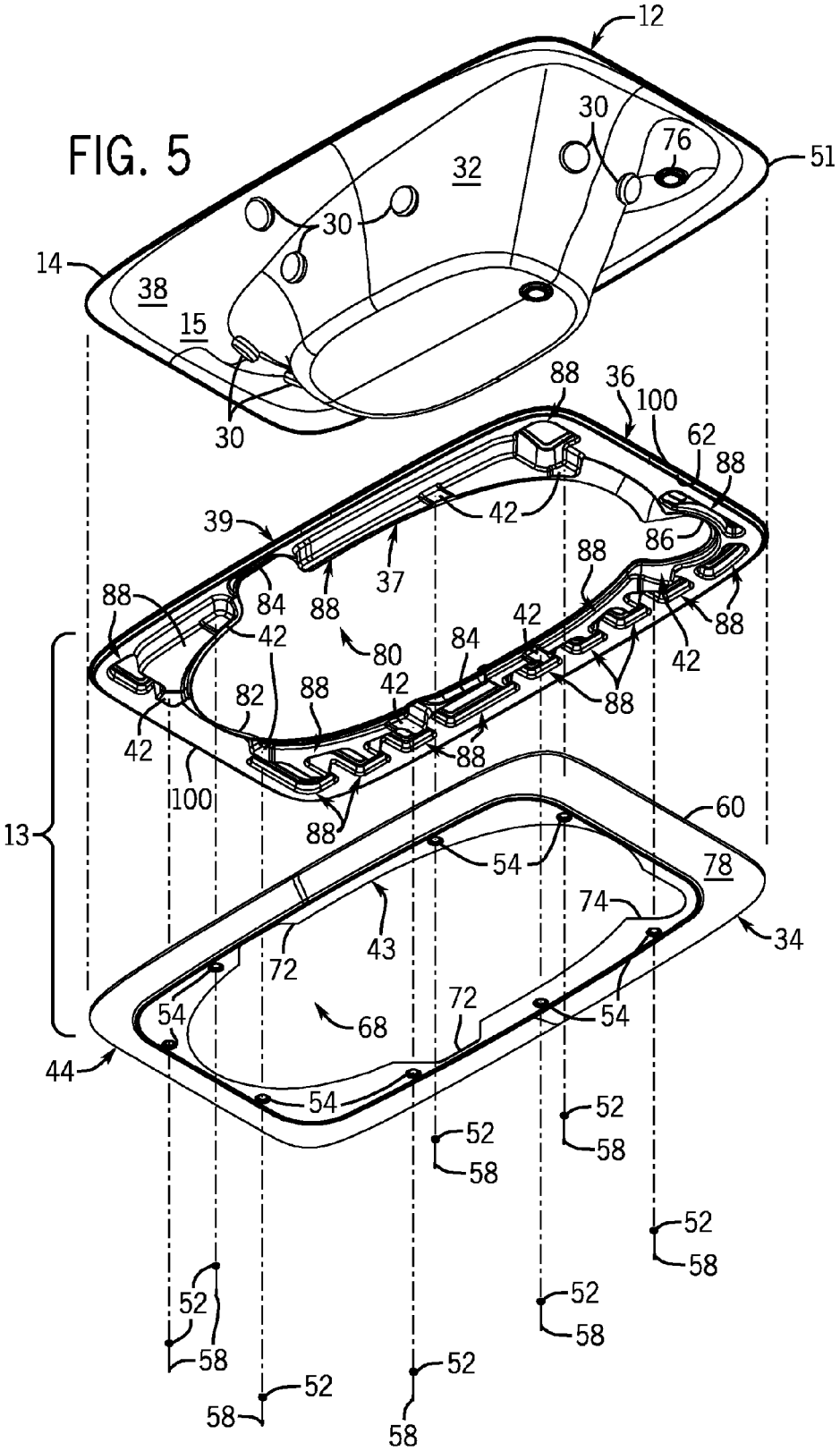
FIG. 5 is a partial exploded view of the bathtub assembly shown in FIG. 1.

With specific reference to FIGS. 5 and 6, a series of isolators 52 are mounted to the skirt 34 and the support structure 36. Each isolator 52 is seated in a mounting pocket 54 molded into the skirt 34. The isolators 52 include a central, countersunk opening 56 receiving a self-taping screw 58 as it passes into the skirt 34 and into the mating surfaces 42 of the support structure 36.

Despite the gap 28 between the skirt 34 and the deck 16, the rim 14 may occasionally flex a sufficient amount resulting in contact between the rim 14 and the deck 16. However, the isolators 52 are preferably made of an elastomeric material capable of absorbing the forces resulting from any interaction between the rim 14 of the bathtub 12 and the mounting deck 16. The isolators 52 need not extend through the skirt 34, but instead may be coupled directly to the support structure 36. Alternatively, the isolators 52 may be secured only to the skirt 34 without engaging the support structure 36. One skilled in the art will appreciate the various isolators 52 and mounting configurations that may be used in accordance with the present invention.

In the preferred embodiment, the gap 28 between the skirt 34 and the deck 16 is at least partially filled with a silicone 29, or the like, as shown in FIG. 6. The silicone 29 seals between the skirt 34 and the deck 16 to prevent water from leaking behind the skirt 34. The silicone 29 also provides additional damping between the ledge 15 and the deck 16, and gives the bathtub 12 the appearance of being integral with the mounting deck 16 and flaring upward and outward therefrom.

With additional reference to FIGS. 7, 8, 11, and 11A-11E, the structure and configuration of the example skirt 34 of the bathtub rim assembly 13 is described in greater detail. The skirt 34 defines a central opening 68 for receiving the basin 18 of the bathtub 12. The inner periphery 43 of the skirt 34 is configured to extend toward the bathtub 12, best shown in FIG. 6.

The skirt 34 substantially obscures or conceals the support structure 36 beneath the skirt 34, thereby helping to maintain the desired bathtub 12 aesthetics. As best shown in FIG. 6, the inner periphery 43 of the skirt 34 is not visible and is obscured by the arrangement of the ledge 15 and the mounting deck 16. Thus, a bather is unable to fully view the inner periphery 43 of the skirt 34, again enhancing the integrated aesthetics of the overall bathtub assembly 10.

In the example embodiment, the skirt 34 includes an intermediate portion 78 between the outer periphery 44 and the inner periphery 43 preferably having a relatively smooth, concave profile (as shown in FIG. 6) that provides an aesthetically pleasing cover over the support structure 36.

The skirt 34 includes a pair of cutouts 72 about the opening 68 that provide clearance for the transducers 30 that are mounted near the rim 14 of the bathtub 12 (e.g., the transducer 30 shown in FIG. 6). Another cutout 74 is formed in the skirt 34 to allow an overflow drain 76 and associated plumbing (not shown) to be fitted to the bathtub 12. The size, location, and quantity of the various cutouts can be adapted for each particular bathtub 12 application.

Turning to FIGS. 9, 10, 11, and 11A-11E, the structure and configuration of the example support structure 36 is described in greater detail. The support structure 36 is contoured to add rigidity to the bathtub 12, especially the cantilevered ledge 15. The inner periphery 37 of the support structure 36 defines a central opening 80 for receiving the basin 18 of the bathtub 12. A flange 82 of the support structure 36 is contoured to mate with the inner shell 12*b* thus helping to ensure a secure bond between the support structure 36 and the bathtub 12. The support structure 36 includes a pair of hoods 84 that partially enclose the transducers 30. Additionally, the support structure 36 includes a cutout 86 for the overflow drain 76.

The support structure 36 has a plurality of strengthening formations 88 defined by a series of undulations 90 that extend substantially normal from a support plane 92. The support plane 92 generally passes through the support structure 36 at the average or mean of the extremes of the entire support structure 36 (best shown in FIG. 6). The strengthening formations 88 are preferably integrally formed in the support structure 36, but may be coupled to the support structure 36 by adhesives, fasteners, and the like.

Figure 11:
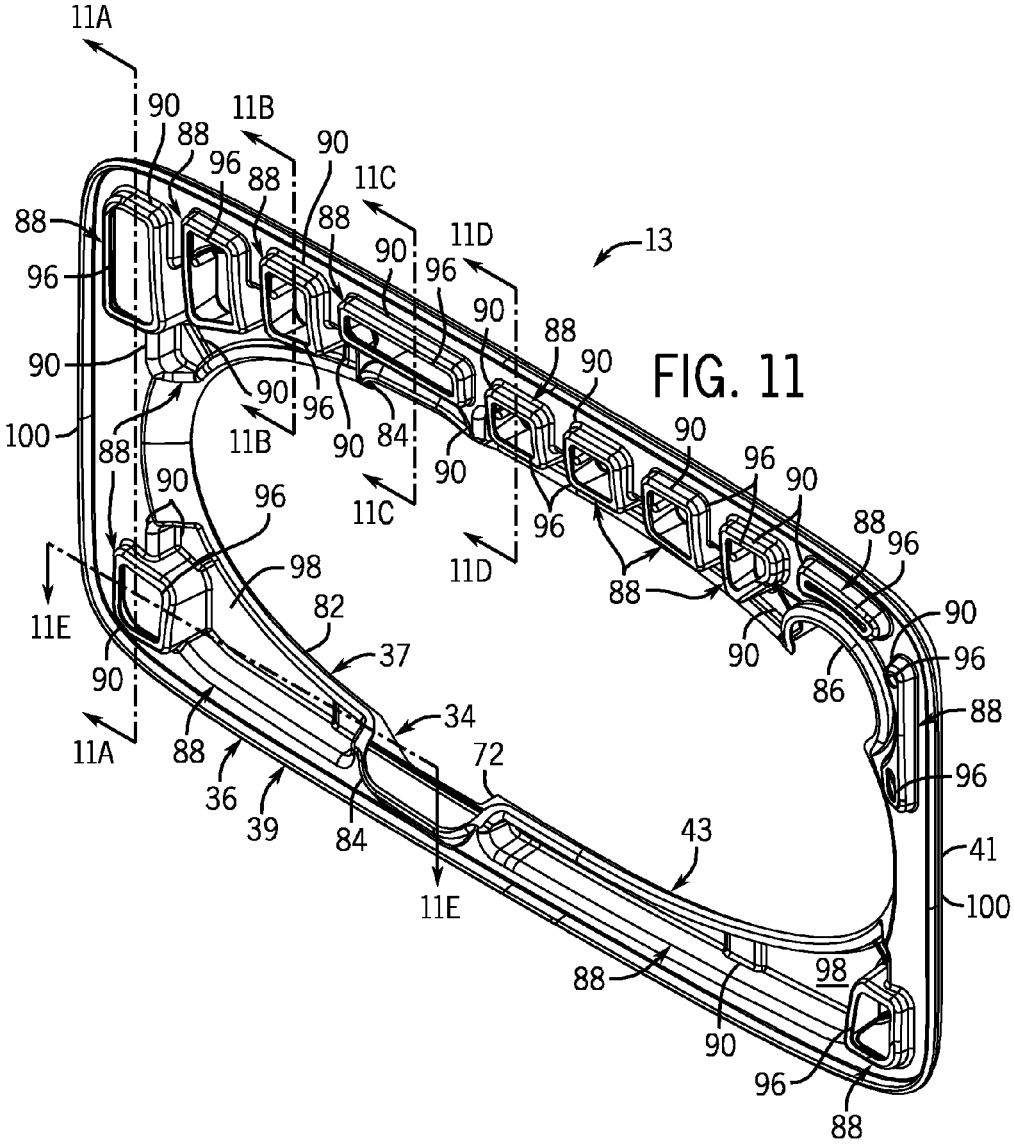
FIG. 11 is a top isometric view of a bathtub rim assembly in accordance with the present invention.

With specific reference to FIGS. 11 and 11A-11E, various cross-sections through the skirt 34 and support structure 36 assembly of FIG. 11 illustrate some of the possible orientations and configurations of the strengthening formations 88. The undulation offset 94 of the undulations 90 from the support plane 92, for example as shown in FIG. 6, may vary in amplitude and direction. For example, and with specific reference to FIG. 11E, a series of strengthening formations 88 are shown, each having undulations 90 defining undulation offsets 94 from the support plane 92.

Figure 11A:
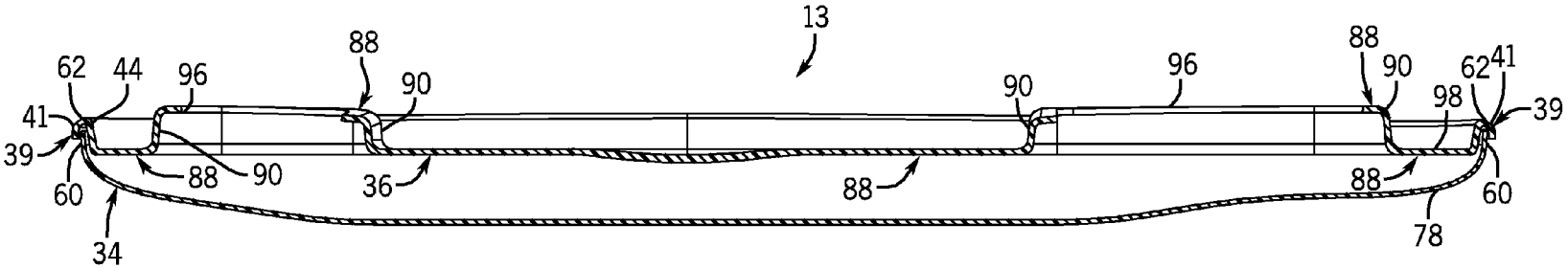
FIG. 11A is a section view along line 11A-11A of FIG. 11.
Figure 11E:
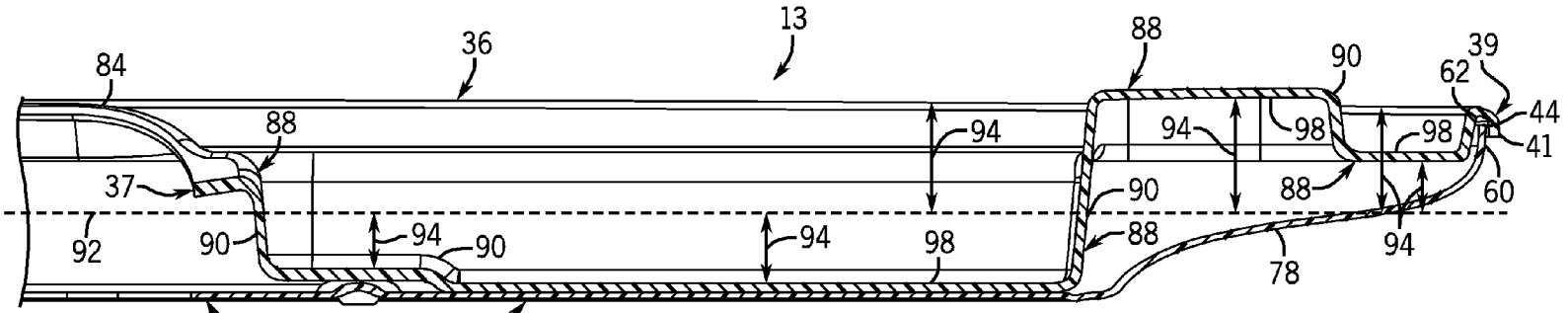
FIG. 11E is a section view along line 11E-11E of FIG. 11.
Figure 11B:
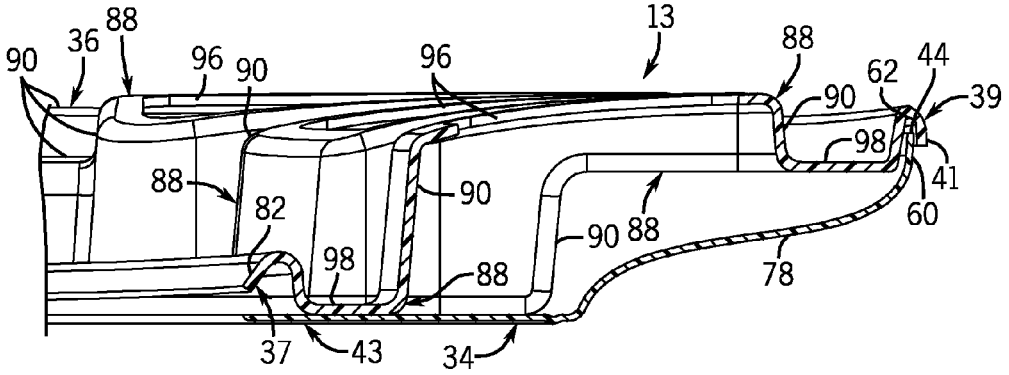
FIG. 11B is a section view along line 11B-11B of FIG. 11.
Figure 11C:
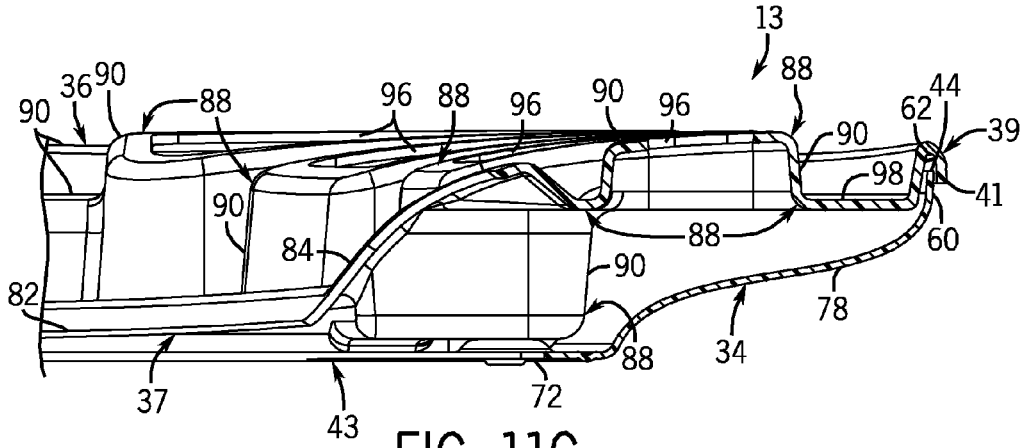
FIG. 11C is a section view along line 11C-11C of FIG. 11.
Figure 11D:
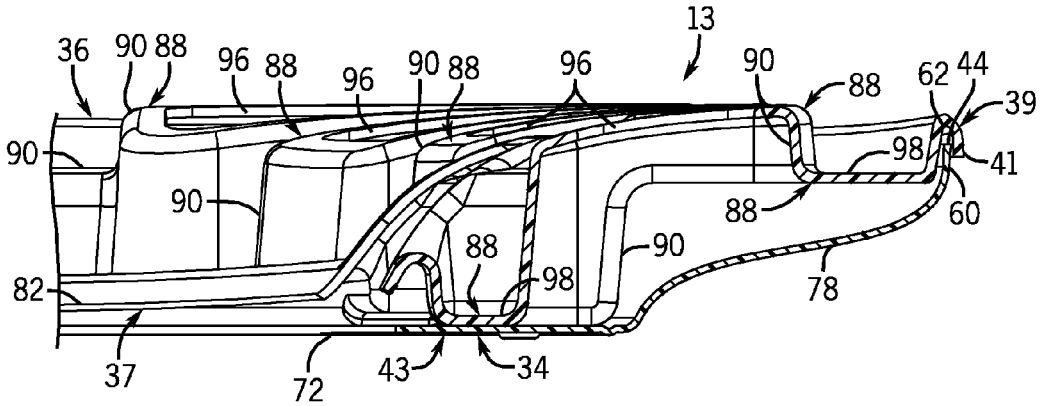
FIG. 11D is a section view along line 11D-11D of FIG. 11.

A first subset of the strengthening formations 88 may define an opening 96 through the support structure 36, as best shown in FIGS. 11A-11C. Alternatively, a second subset of the strengthening formations 88 do not extend through the support structure 36, thereby forming a close-ended pocket 98.

The arrangement and orientation of the first subset and second subset of the strengthening formations 88 may vary greatly from the example configuration shown. For example, a number of strengthening formations 88 may be included proximate the short ends 100 of the support structure 36, especially in situations in which the mating bathtub 12 has a cantilevered ledge 15 that may benefit from the added rigidity provided by the support structure 36. Furthermore, the geometry of the strengthening formation 88, including the offset 94 and angle of extension of the undulations 90, is readily altered from that illustrated by one skilled in the art.

The assembly and installation of the bathtub assembly 10 involves engaging the support structure 36 with the bathtub 12, preferably by imbedding the support structure 36 at least partially into the inner shell 12*b* of the bathtub 12 while the bathtub 12 is not yet fully cured (e.g., embedding the support structure 36 into a general purpose polyester resin within approximately five minutes of spraying the resin). After the bathtub 12 is sufficiently cured (e.g., curing for a minimum of about forty-five minutes at approximately seventy degrees Fahrenheit), the skirt 34 is then coupled to the support structure 36 in two locations. First, the flange 60 of the skirt 34 is seated in the channel and preferably secured with a silicone 66. The isolators 52 are then secured to the skirt 34 and support structure 36 via screws 58 and thus couples the skirt 34 and support structure 36 to the bathtub 12. The entire bathtub assembly 10 is then inserted into the opening 17 in the mounting deck 16 where it is supported by the mounting blocks 26 and mounting brace 27. The mounting blocks 26 and mounting brace 27 are shimmed to ensure the gap 28 remains between the bathtub assembly 10 and the mounting deck 16. Lastly, the silicone 66 and silicone 29 may be applied to complete the installation. One skilled in the art will appreciate the various assembly and installation alterations that are within the scope of the present invention.

As a result, the support structure 36 supports the cantilevered ledge 15 of the bathtub 12 that is spaced apart from the mounting deck 16, while the skirt 34 generally obscures the support structure 36 and provides a substantially uniform appearance between the bathtub 12 and the bathtub rim assembly 13.

While the preferred example embodiment describes the outer periphery 44 of the skirt 34 engaging the outer periphery 39 of the support structure 36, the outer periphery 44 of the skirt 34 need only be overlapped (not necessarily contacted) by one of the outer periphery 39 of the support structure 36 or the ledge 15. For example, where the support structure 36 does not include the downwardly depending lip 41, the skirt 34 may be overlapped by a lip 51 formed in the ledge 15.

The desired aesthetics are achieved by covering at least a portion of the outer periphery 44 of the skirt 34 with either the outer periphery 39 of the support structure 36 or with the ledge 15 alone. Engaging or coupling the outer periphery 44 of the skirt 34 to either the outer periphery 39 of the support structure 36 or the ledge 15 adds some structural rigidity to the overall bathtub rim assembly 13.

A preferred example embodiment of the present invention has been described in considerable detail. Many modifications and variations of the preferred example embodiment described will be apparent to a person of ordinary skill in the art. Therefore, the invention should not be limited to the example embodiment described.

INDUSTRIAL APPLICABILITY

The invention provides a bathtub rim assembly for a consumer bathtub that provides support to a rim of the bathtub, reduces the transmission of bathtub vibrations to the surrounding mounting deck, and establishes an aesthetically pleasing, substantially unitary appearance between the bathtub rim assembly, the bathtub, and the mounting deck.

We claim:

1. A bathtub rim assembly mounted to a bathtub, installed on a deck structure, and having a rim defining an at least partially cantilevered ledge spaced apart from the deck structure, comprising:

a support structure defining a plurality of strengthening formations, having an inner periphery defining an opening for receiving the bathtub and permitting a portion of the bathtub to extend therethrough, and having an outer periphery; and a skirt having an inner periphery for receiving the bathtub and permitting a portion of the bathtub to extend there through, and an outer periphery; and a downwardly depending lip defined by at least one of the outer periphery of the support structure and an outer periphery of the ledge for overlapping the outer periphery of the skirt such that the lip depends outside the outer periphery of the skirt;

wherein the support structure is disposed adjacent the ledge of the bathtub to support the ledge; and wherein the skirt is disposed to a side of the support structure opposite the ledge such that the outer periphery of the skirt is overlapped by at least one of the outer periphery of the support structure and the ledge to establish a substantially unitary appearance between the ledge and the skirt.

2. The bathtub rim assembly of claim 1, wherein the downwardly depending lip comprises the outer periphery of the support structure.

3. The bathtub rim assembly of claim 1, wherein the outer periphery of the skirt includes an upwardly extending flange that extends into a channel defined by the lip defined by at least one of the support structure and the ledge.

4. The bathtub rim assembly of claim 1, wherein the skirt is coupled to the support structure.

5. The bathtub rim assembly of claim 4, wherein an isolator is mounted between the bathtub rim assembly and the deck structure.

6. The bathtub rim assembly of claim 1, wherein when the support structure is mounted to the bathtub, the support structure is at least partially embedded into the bathtub.

7. The bathtub rim assembly of claim 1, wherein the strengthening formations include a series of integrally formed undulations.

8. The bathtub rim assembly of claim 7, wherein the strengthening formations define a plurality of pockets and a plurality of openings formed in at least some of the plurality of pockets.

9. The bathtub rim assembly of claim 1, wherein at least a portion of the inner periphery of the skirt is obscured by the ledge and the deck structure.

10. The bathtub rim assembly of claim 9, wherein the inner periphery of the skirt extends substantially toward the bathtub.

11. A bathtub rim assembly mounted to a bathtub, installed on a deck structure, and having a rim defining an at least partially cantilevered ledge spaced apart from the deck structure that has an opening through which a basin of the bathtub extends, comprising:

a support structure disposed adjacent the ledge of the bathtub to support the ledge, defining a plurality of strengthening formations, forming a first closed loop configured to permit a portion of the bathtub to extend therethrough, and having an outer periphery defining a downwardly depending lip; and a skirt having:

an outer periphery defining an upwardly extending flange;

a first side disposed adjacent the support structure opposite the ledge such that the lip of the support structure overlaps at least a portion of the flange of the skirt to establish a substantially unitary appearance between the ledge and the skirt;

a second side opposite the first side; and an inner periphery for receiving the bathtub and permitting a portion of the bathtub to extend through the skirt beyond the second side of the skirt.

12. The bathtub rim assembly of claim 11, wherein the support structure is spaced apart from the deck, and the skirt is coupled to the support structure between the support structure and the deck.

13. The bathtub rim assembly of claim 12, wherein an isolator is mounted between the bathtub rim assembly and the deck structure.

14. The bathtub rim assembly of claim 11, wherein when the support structure is mounted to the bathtub, the support structure is at least partially embedded into the bathtub.

15. The bathtub rim assembly of claim 11, wherein the strengthening formations include a series of integrally formed undulations.

16. The bathtub rim assembly of claim 15, wherein the strengthening formations define a plurality of pockets and a plurality of openings formed in at least some of the plurality of pockets.

17. The bathtub rim assembly of claim 11, wherein at least a portion of the inner periphery of the skirt is obscured by the ledge and the deck structure.

18. A method of installing a bathtub rim assembly to a bathtub having a resin portion and a rim defining an at least partially cantilevered ledge, comprising the steps of:

providing a support structure defining a plurality of strengthening formations, and having an inner periphery for receiving the bathtub and permitting a portion of the bathtub to extend therethrough, and an outer periphery;

providing a skirt having an inner periphery for receiving the bathtub and permitting a portion of the bathtub to extend there through, and an outer periphery;

engaging the support structure and the ledge of the bathtub to embed at least a portion of the support structure into the resin portion of the bathtub proximate the ledge before the resin portion has fully cured;

curing the bathtub to substantially couple the support structure and the bathtub; and overlapping at least one of the outer periphery of the support structure and the ledge over the outer periphery of the skirt to establish a substantially unitary appearance between the ledge and the skirt.

19. The method of claim 18, further comprising the step of applying an adhesive to the support structure and the bathtub to bond the support structure to the bathtub.

20. The bathtub rim assembly of claim 11 further comprising a plurality of vibrating transducers mounted proximate the rim;

wherein the skirt defines a plurality of cutouts about the inner periphery of the skirt, the cutouts configured to provide clearance for the vibrating transducers.

* * * * *